US005437324A

United States Patent [19]

Sternquist

[11] Patent Number: 5,437,324

[45] Date of Patent: Aug. 1, 1995

[54] SHADE WITH VARIABLE LOAD BRAKING AND LIFT ASSIST

[75] Inventor: Alan R. Sternquist, Pleasanton, Calif.

[73] Assignee: Newell Operating Company, Freeport, Ill.

[21] Appl. No.: 183,737

[22] Filed: Jan. 19, 1994

[51] Int. Cl.[6] ..... E06B 9/56

[52] U.S. Cl. ..... 160/299; 160/307; 160/317

[58] Field of Search ..... 160/229, 305, 307, 316, 160/317, 319, 321, 293.1, 294, 405, 295

[56] References Cited

U.S. PATENT DOCUMENTS

| | | | |
|---|---|---|---|
| Re. 31,793 | 1/1985 | Berman et al. . | |
| 350,656 | 10/1886 | Brook | 160/293.1 |
| 958,605 | 5/1910 | Doring . | |
| 1,132,830 | 3/1915 | Cole | 160/316 X |
| 1,591,104 | 7/1926 | Robinson . | |
| 1,605,111 | 11/1926 | Holt et al. . | |
| 1,709,305 | 4/1929 | Brunst et al. | 160/317 X |
| 1,938,729 | 12/1933 | Traut . | |
| 4,223,714 | 9/1980 | Weinreich et al. . | |
| 4,323,105 | 4/1982 | Berman et al. . | |
| 4,535,830 | 8/1985 | Appel et al. . | |
| 5,275,223 | 1/1994 | Magro et al. | 160/316 X |

FOREIGN PATENT DOCUMENTS

| | | | |
|---|---|---|---|
| 238426 | 8/1925 | United Kingdom | 160/299 |

*Primary Examiner*—David M. Purol
*Attorney, Agent, or Firm*—Foley & Lardner

[57] ABSTRACT

The present invention provides a roller shade with a variable load brake and, in a modification thereof with a lift assist. The load brake includes a compressible spring surrounding a threaded rod, the spring acting against a traveling nut mounted on the rod. The compressive friction of the traveling nut against the threads of the threaded rod continually varies during raising and lowering of the shade to provide the variable load braking capability. The lift assist uses at least one torsion spring, also associated with a shaft and coupled between a nonrotating flange and a nipple rotationally anchored to the shaft. The torsion spring system is increasingly loaded when the shade is lowered.

23 Claims, 2 Drawing Sheets

FIG. 2
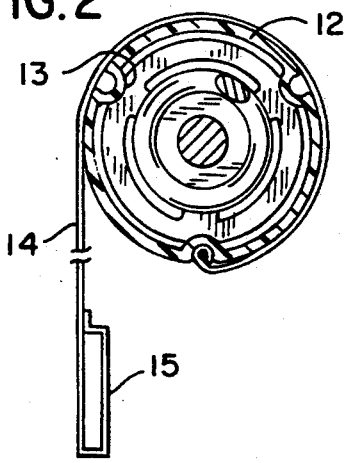
FIG. 3
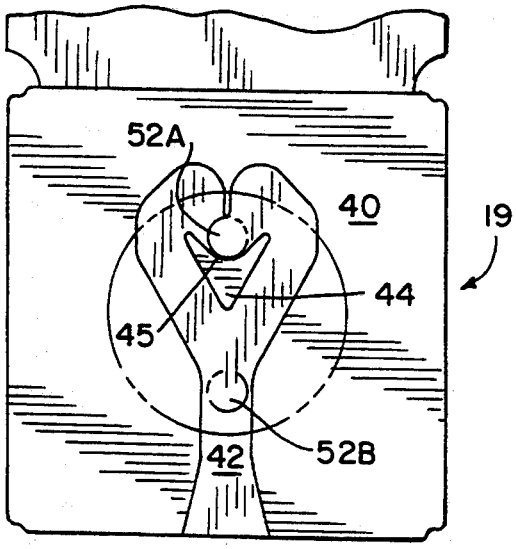
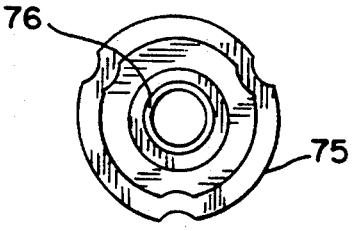
FIG. 4
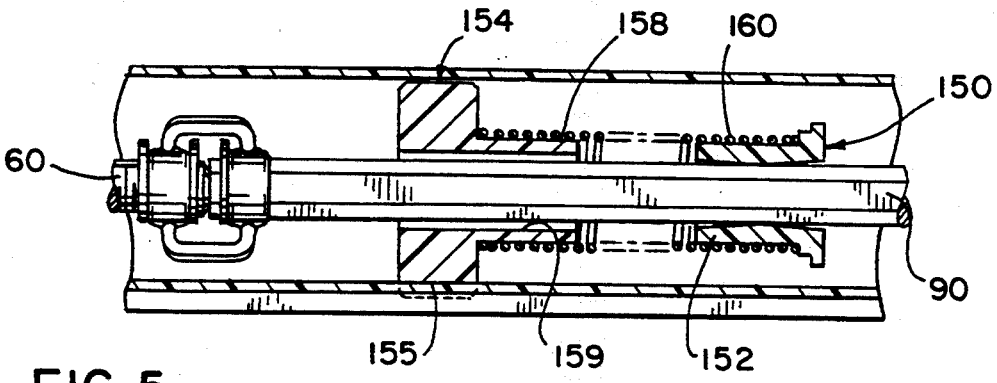
FIG. 5

SHADE WITH VARIABLE LOAD BRAKING AND LIFT ASSIST

BACKGROUND OF THE INVENTION

1. Field of the Invention

The present invention relates generally to the art of roller shades, and more particularly to an improved roller shade which includes a variable force braking feature to prevent the shade from self-lowering as shade material is unwound from the roller tube. In its most preferred embodiment, the invention also includes a lift assembly to assist in raising the shade.

2. Description of the Prior Art

Roller shades have been known for many years and are available for a wide variety of applications. Smaller shades may be used in residences, and much larger units are used for commercial applications, e.g., office buildings, hotels, restaurants, etc. Most prior art shades include mounting brackets for supporting opposed ends of a tube, around which the shade material is rolled. Many of the prior art shades also include some form of lift assist, usually a spring element which is wound when the shade is lowered and released when the shade is raised. In smaller units the lowering of the shade results in a noticeable increase in the force required, due to the action of the spring, and latching mechanisms (e.g., ratchet and pawl systems) are frequently employed to keep the shade in a desired position. When it is time to raise the shade, the latching mechanism is deactivated and the spring assists in raising the shade to either a full roll-up or to an intermediate location.

Different operational factors are involved in the design of commercial shades, mainly due to their larger size and to the heavier shade materials frequently employed. As the shade material is unrolled during the lowering step, it exerts a torque on the tube, and in many applications it is considerable. In the absence of some additional shade components, the weight of the unrolled shade material can result in undesirable free-falling. In a related aspect of these larger shades, the considerable weight of the unrolled shade material prevents the use of common lift assist springs and creates difficulty during shade raising.

Several U.S. patents address certain of the aforementioned characteristics of shade construction and use. For example, U.S. Pat. No. 4,535,830 issued Aug. 20, 1985 to Appel, et al. for "Lateral-Traction Roller Shade" discloses a stationary rod inside the shade cylinder and a retraction spring having an end secured to the rod. The other end rotates about the interior rod to act as a lift assist.

In U.S. Pat. No. 1,938,729 issued Dec. 12, 1933 to Traut for a "Spring Roller", a torsion spring is wound by a bushing with a key groove engaging a rib on the roller tube. The arrangement is said to materially reduce the frictional wear on the moving parts.

Robinson, in U.S. Pat. No, 1,591,104 issued Jul. 6, 1926 for "Window Shade Roller" discloses a threaded nut moving on a threaded rod between two friction discs. In this arrangement, a spring is compressed toward the nut to separate the discs and relieve the frictional pressure on a bracket.

Holt, et al., in U.S. Pat. No. 1,605,111 issued Nov. 2, 1926 uses a different mechanism in a "Shade Roller", i.e. one which employs a torsion spring having two ends. One end is anchored to the axle of the shade, while the other end is fixed to two devices which form a sliding, non-rotative bung engaged with a rib extending along the shade roller. The stored energy is apparently used to lift the shade, although the patent description is unclear.

On May 17, 1910, U.S. Pat. No. 958,605 was issued to Doring for an "Automatic Curtain Roller." In this device a traveling nut and a compressible spring are used in a roller shade. However, no friction mechanism is shown, and when the roller is fully lowered, its hem is secured by an eyelet engaging a peg or stud driven into the window casing. The spring which moves the traveling nut rotates the spindle of a roller (using toothed wheels), thereby winding or raising the curtain shade. The drive functions as a lift assist, rather than as a variable load braking device.

Finally, three patents have been issued to Berman, et al for "Window Shade Roller Assembly", namely U.S. Pat. No. 4,323,105 issued Apr. 6, 1982, U.S. Pat. No. 4,223,714 issued Sep. 23, 1980 and U.S. Pat. No. Re. 31,793 issued Jan. 8, 1985. In each of these patents a shaft passes through the drive mechanism and a spring is placed over the shaft to help insure proper positioning and operation of the mechanism. The spring forces exerted against the drive components also are said to prevent the roll from rotating and unwinding the shade which may occur due to the weight of a partially lowered shade.

While various types of lift assists and other spring systems are known in the art, none of them provide a desirable variable load braking capability, alone or in combination with a lift assembly. An improved shade which solves the above-noted problems with prior art shades and which features a variable load braking system which can be used in a stand alone fashion or combined with a lift assist, would represent a significant advance in this art.

SUMMARY OF THE INVENTION

The present invention features a variable load braking system for roller shades which provides desirable braking forces throughout the range of shade movement, i.e., from fully opened to fully closed. The present invention further features a variable load braking system which may readily be adapted to a wide variety of shade designs.

The present invention also features a variable load braking system which is reliable and of relatively simple construction and which may be combined with a lift assembly system to provide the dual benefits of braking and lift assist. In its most preferred form, the present invention features a combined variable load brake for roller shades and a lift assist which employs a minimal number of parts, making the dual system readily adaptable to a wide variety of shade sizes and designs.

How the present invention provides the features mentioned above (as well as other features which will become readily apparent to those skilled in the art after they have read the present specification) will be described in the following detailed description of the most preferred embodiment of the invention, taken in conjunction with the FIGURES. Generally, however, they are accomplished by a roller shade which includes a brake comprising three main components, a traveling nut, a compression spring and a threaded rod mounted at the axis of the shade tube. The nut is threadingly mated with the rod, the latter being rotationally fixed with respect to earth. A groove on the nut mates with a spline on the inner tube wall to prevent the nut from rotating, except when the tube rotates. The spring is mounted about the threaded rod and is arranged to exert an increasingly strong compression force against the traveling nut as the shade is lowered. The frictional forces resist movement of the tube, all in portion to the amount the shade has been unwound. The frictional forces act perpendicularly to the axis of the rod at the pitch radius of the threads. This force, at a distance, sets up a torque opposing that due to the weight of the shade acting at the radius of the tube-fabric bundle. When the proper spring is chosen for a particular shade size and material weight, it will react with a force great enough to keep the shade from free-falling, yet allow easy operation with the normal opening and closing mechanisms. The spring force can be field adjusted simply by the rotation of the traveling nut before it is inserted into the tube to provide a desired initial force setting.

The lift assist features of the most preferred embodiment are provided by five components, namely a flange, a nipple, a torsion spring arrangement, a spring connector and a shaft. The flange is grooved to mate with the spline in the tube, and it and the connector have central openings large enough to clear the shaft. The flange, nipple and connector have threaded portions to which torsion springs are fastened. The nipple is rotationally anchored to the shaft. The shaft in turn is coupled to the threaded rod or otherwise so that it also is rotational fixed with respect to earth. When the shade is lowered, the torsion spring system is loaded, and it assists the operator when the shade is being lifted.

A particular feature of this invention is the ability to reverse the brake and lift assembly, end for end, to handle shades with either clockwise or counterclockwise rotation. Moreover, for very large shades requiring more lift assist, the springs can be connected in parallel, using a longer shaft and a second, third or more flange/spring/nipple/connector assemblies.

Other ways in which the features of the present invention are accomplished will become apparent in the following detailed description, and the scope of the invention is meant to include such other ways, all as reflected in the claims which will follow.

DESCRIPTION OF THE DRAWINGS

FIG. 2 is a cross-sectional view of the shade shown FIG. 1 taken along the line 2—2 thereof;

FIG. 3 is a cross-sectional view of the shade for use at the idle side of the device shown in FIG. 1;

FIG. 4 is an end view of a traveling nut useful in the device shown in FIG. 1; and FIG. 5 is an alternate lift assembly spring system including only four components.

In the various FIGURES, like reference numerals are used to indicate like components.

DETAILED DESCRIPTION OF THE PREFERRED EMBODIMENT

Figure 1:
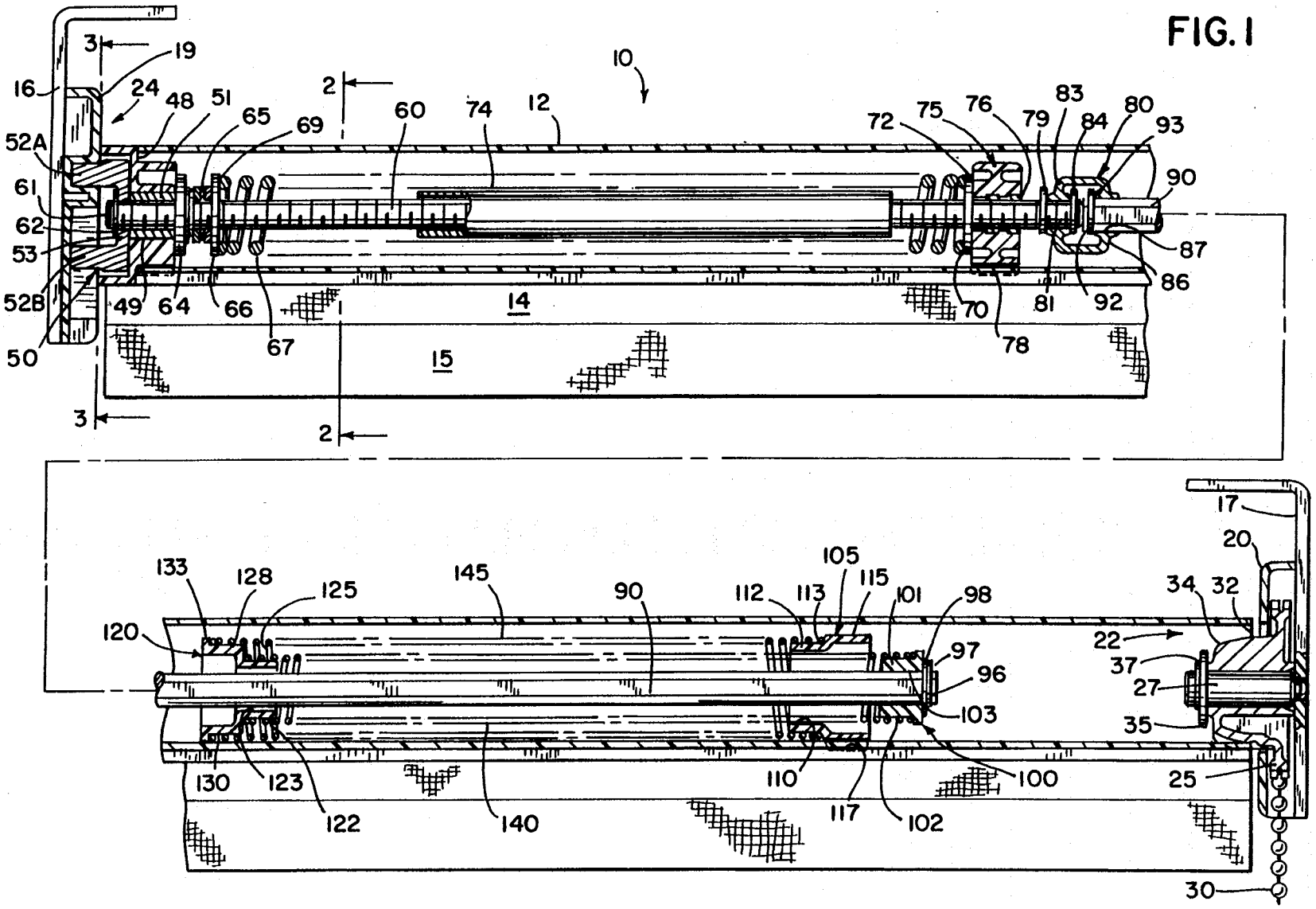
FIG. 1 is a schematic view, partially in section, showing the major components of the variable brake and lift assist system according to a preferred form of the present invention, along with associated shade and mounting components.

Before proceeding to a detailed description of the preferred embodiment, several comments need to be made about the general applicability and scope of the present invention. First, while the illustrations and description will focus on a most preferred embodiment which includes both a variable brake device and a lift assist, the components could be used separately for their individual purposes. Second, as mentioned in the summary above, the proper selection of spring length and stiffness, and the number of lift assist sub-assemblies which may be required for a particular application, will vary depending on the size of the shade and the weight of the shade material. These factors can be readily appreciated by those skilled in the art after they understand the various aspects of the present invention. Third, while the illustrations show a chain drive system for raising and lowering the shade, the invention has applicability to other types of shades with different raising and lowering mechanisms. Further, the various materials of construction can be selected from those used in this art. While it is preferred that the major components be metal or synthetic resins, individual choices will be readily made by those skilled in the art after reading the instant specification. Finally, the invention has applicability to a wide variety of tube diameters and lengths.

Preceding now to FIG. 1, a roller shade having both variable braking and lift assist capabilities is designated at reference numeral 10. The shade includes a tube 12 of generally cylindrical configuration, except for splines 13 formed along its length (the number of splines could be varied widely), as best seen in FIG. 2. Shade material 14 is wound about the tube (in this case in a "back roll" configuration), and a hem bar 15 is provided at its lower end. Typically a hem bar is used to provide additional weight to insure that the shade hangs properly. The end of shade material 14 opposite the hem bar 15 is attached to tube 12 in any conventional manner, e.g. at one of splines 13.

Brackets 16 and 17 are provided at opposed ends of shade 10 for supporting it in a horizontal position at a desired height and for permitting its rotation about the tube axis. This is accomplished using a pair of end covers 19 and 20, which end covers are different at the drive end 22 and the idle end 24. Dealing first with the drive end 22, end cover 20 includes a sprocket 25 rotationally mounted to bracket 17 by a shaft 27. Cover 20 includes a pair of holes (not shown) at its lower end to permit a drive chain 30 to be wound around the sprocket 25 for rotating same about the axis of shaft 27. This axis is coincident with the axis of tube 12. At the drive end 22 of tube 12, a sprocket extension 34 engages the tube. A washer 35 and a retainer 37 both pass around shaft 27 and lock the sprocket axially. It will be appreciated then that as drive chain 30 is moved, rotation of the sprocket 25 will occur, leading to a rotation of the end cap 32, and in turn rotation of tube 12.

The idle end cover 19 is shown in FIG. 3 and includes a body 40 having a slot 42 extending from the lower edge thereof toward its center. Located generally above the center of the body 19 is a y-shaped member 44 having a receiving area 45 thereon. Component 44 is formed integrally with body 40 and the purpose of it will become apparent as the description continues.

An end cap 48 is provided for the idle end 24, end cap 48 fitting snugly and engaging spline 13 within tube 12 and having a generally cylindrical bore 49. A bearing element 50 is interposed between end cap 48 and cover 19, bearing element 50 including a cylindrical portion 51 which is internally threaded (not shown) and a pair of generally cylindrical and spaced apart posts 52A and 52B extending from an annular plate portion 53. The bearing element is inserted in cover 19 by sliding the upper post 52A into slot 42 and raising it toward component 44. When post 52A encounters component 44, the latter will act as a caming device causing a resistance as upward movement is continued. Additional pressure will force post 52A around the upper ends of component 44, at which point post 52A will fall into receiving area 45. Bottom post 52B will then reside in slot 42. It will be appreciated then that tube 12 may rotate about the tubular portion 51 of bearing element 50, and that the bearing element 50 itself is fixed with respect to earth.

A threaded, elongate shaft 60 is axially disposed within tube 12 and is threadingly engaged with tubular portion 51 of bearing element 50. A first end 61 of shaft 60 passes through plate 53 and into the area between posts 52A and 52B where it is locked in position using a retaining ring 62. At the inner end of tubular portion 51 a pair of washers 64 and 66 surround shaft 60 and a thrust bearing 65 is placed therebetween. The thrust bearing 65 is preferably of the ball bearing type.

Proceeding toward the right in the description of FIG. 1, the next element encountered is a compression spring 67 which surrounds shaft 60 and has a first end 69 abutting washer 66. The second end 70 of spring 67 abuts yet another washer 72. A hollow, cylindrical spacer bar 74 may be provided about threaded shaft 60 to prevent buckling of the spring 67 during radial deflection of the spring, but this component is not essential to the functioning of the present invention.

The next component of the illustrated preferred embodiment is a traveling nut 75 (shown also in FIG. 4) which includes a threaded inset 76 engaging shaft 60 and a groove 78 in its outer circumference adapted to engage one of the splines 13 of tube 12. Such engagement will cause nut 75 to rotate as tube 12 rotates. In the arrangement illustrated, when shade 10 is lowered, traveling nut 75 will move toward the idle end 24, resulting in compression of spring 67. Such movement will create spring forces against the washer 72 and in turn against nut 75. This force, acting back on the nut 75 is conveyed to the threaded shaft 60 perpendicularly to the axis of the shaft at the pitch radius of the threads. This force, at a distance, sets up a torque opposing that created by the weight of the shade material acting on the radius of the tube-fabric bundle.

The spring 67 should be selected to be of sufficient stiffness that it will react with a force great enough to keep the shade from free-falling, yet be sufficiently resilient to allow normal operation of shade 10 using chain 30. When hem bar 15 is in its highest position, the torque due to the weight of the shade material is at its lowest point. As the shade is lowered, the torque will be increased. The increase in torque is nearly linear with respect to the number of turns of fabric. Also, the increase in counter torque due to the frictional forces set up by the spring are linear with respect to the number of turns. Therefore, this brake design is ideal, since the magnitude of its force increases automatically when greater resistance is required and decreases when less is required.

Another significant advantage of the present invention will be apparent from the foregoing description, that is the ability to preset the spring forces depending on a particular application. Moreover, the pre-established spring force may be field adjusted. This is accomplished simply by rotating the traveling nut to a particular location before it is engaged with a spline 13 and slid into tube 12. All known prior art systems which involve any type of brake (and none are known to provide the variable braking force of the present invention) set the spring force at the manufacturing location.

Before proceeding to the remaining components of the most preferred embodiment of the present invention, it should be mentioned here that the traveling nut inset 76 need not be used if a nut 75 is tapped to the desired internal thread configuration. We have found the threaded inset to be preferred, however.

If it is desired to provide only the variable force brake assembly, the components described to this point would suffice. Merely putting some form of retainer, such as a retaining ring at the end 81 of threaded rod 60 would complete such a device. However, the brake components of the present invention will be illustrated in combination with a novel lift assist to now be described.

In FIG. 1, a coupler 80 is shown at the second end 81 of shaft 60. A first leg 83 of coupler 80 is threaded to shaft 60 and is locked thereto by retainers 79 and 84. Coupler 80 has a second leg 86, having an opening 87 therein. In the illustrated embodiment, the opening is hexagonal and is adapted to receive an hexagonal rod 90 having a first end 92 secured within coupler 80 by a retainer 93. The second end of rod 90 is located nearer the drive end 22 and is indicated by numeral 96. A retainer 97 secures a washer 98 adjacent end 96 and locks a nipple 100 thereon. Nipple 100 includes a cylindrical portion 101 having a threaded outer surface 102. Portion 102 will be used to secure a torsion spring, as will be apparent when the remaining components are described. A hexagonal bore 103 within portion 101 rotationally fixes the nipple 100 to rod 90.

A flange 105 is located generally adjacent nipple 100 and includes an internal bore 110 substantially larger than rod 90. Flange 105 includes two cylindrical portions, the first 112 defining a bore 110. Portion 112 has an outer threaded surface 113. A second portion of flange 105 is designated as 115, this portion having a greater diameter than portion 113. Portion 115 includes a groove 117, the groove being similar to the groove 78 provided on the traveling nut 75. Groove 117 engages a spline 13 of tube 12, thereby causing rotation of flange 105 only as tube 12 is rotated.

A spring connector 120 is provided about shaft 190 and generally nearer the coupler 80. Connector 120 has three portions, the first being generally cylindrical and being designated at 122. Portion 122 has an internal bore 123, which exceeds the diameter of rod 90, and an outer threaded surface 125 having the same diameter as portion 102 of nipple 100. Located nearer coupler 80 is an expanded diameter tubular portion 128 having a threaded outer surface 130, the latter having the same diameter as surface 113 of flange 105. A final portion of even greater diameter is designated at 133. However, it should be noted that this portion does not include a groove engaging a spline of tube 12. Therefor, connector 120 does not rotate with tube rotation, other than indirectly as will be described.

A first coil torsion spring 140 is threadingly engaged with the tapered threads at area 125 on connector 120 and on area 102 of nipple 100. A second torsion spring 145 is threadingly coupled to the area 113 of the flange 105 and to the tapered thread portion 125 of connector 120.

From this description, it can now be seen that when the tube 12 is rotated, the torsion springs 140 and 145 will be loaded during lowering of the shade and will be unloaded during raising thereof. As flange 105 rotates, it will cause torsional loading of the spring 145 and rotation of connector 120, which in turn will cause a loading of the spring 140 connecting connector 120 and nipple 100. The spring forces will instantaneously react on the flange 105, providing a lift assist as increasing torsion is created during the lowering step. The foregoing is a description of a coaxial spring arrangement. This arrangement allows the spring to be compacted into a much shorter length than a single spring. The length of the required single spring could exceed the width of the shade, making manufacture impossible.

FIG. 5 shows a modification of a lift assembly which may be used in the present invention, this modification employing only two components in addition to a torsion spring and the shaft 90. A nipple 150 having an externally threaded tubular portion 152 is fixed to the rod 90. As before, rod 90 is locked against rotation by being coupled to the threaded shaft 60. A flange 154 having a groove 155 for engagement with a spline 13 of tube 12 is also provided. The flange 154 includes a tubular threaded portion 158 and a bore 159 exceeding the diameter of rod 90. In this more simplified version, spring forces are directly provided by a single torsion spring 160 coupling portions 158 and 152.

Now that the basic components of the present invention have been described, several additional comments will indicate the wide variety of applications in which they may be used. Both the lift assembly and brake may be readily modified for right or left handed systems simply by reversing the components end to end. Accordingly, the same components may be used whether the shade is wound in a clockwise or counterclockwise direction. In the prior art, this has been accomplished primarily with special springs selected for one or the other type of shade. It may be that as few as one spring will be required (as shown in FIG. 5) or that a number of lift assist packages may be provided and arranged end to end along rod 90. Acting in parallel, they provide greater lift assist. Other variations include the use of stronger single springs or multiple springs with less spring forces.

While the present invention has been described in connection with one preferred embodiment, and one alternate embodiment for the lift assist, several variations have been discussed and are deemed to fall within the scope of the invention. Accordingly while the description has been limited with respect to the number of embodiments shown, the invention's scope is to be limited solely by the claims which follow.

What is claimed is:

1. A roller shade of the type including a generally cylindrical tube for winding and unwinding a shade material attached thereto and also comprising a variable load brake for resisting the tendency of the shade to free-fall as increasing amounts of shade material are unwound therefrom, the brake including:

a threaded member mounted within the tube, a rotary member threadingly engaged with the threaded member and arranged to move therealong when the tube is rotated, and a spring in the tube engaging the rotating member and arranged to exert an increasing force against the rotating member when shade material is unwound from the tube and a decreasing force against the rotating member when shade material is wound on the tube.

2. The shade of claim 1 wherein the threaded member is a threaded rod arranged axially within the tube and fixed against rotation when the tube rotates.

3. The shade of claim 2 wherein the rotating member is a traveling nut threadingly engaged with the rod.

4. The shade of claim 3 wherein the spring is a coil compression spring surrounding the rod and having first and second ends, the first end within the tube and a second end engaging the traveling nut.

5. The shade of claim 3 wherein the traveling nut engages the tube so that the nut will rotate as the tube is rotated.

6. The shade of claim 5 wherein the tube includes an elongate spline along its length and generally parallel to the axis of the tube and wherein the nut includes a groove adapted to matingly engage the spline.

7. The shade of claim 1 further including a lift system to supply an assisting force to wind unrolled shade material onto the roll.

8. The shade of claim 7 wherein the lift system includes a shaft mounted within the tube and fixed with respect to tube rotating, a flange freely surrounding the shaft and arranged for rotation with the tube, a nipple secured to the shaft and torsion spring means coupling the flange and nipple for increasing spring forces toward tube rewinding as shade material is unwound from the tube and decreasing spring forces toward rewinding when shade material is being rolled onto the tube.

9. The shade of claim 8 wherein the flange and nipple each include tapered threaded portions and a torsion spring is threaded on to each.

10. The shade of claim 7 wherein the shaft is coaxial with the threaded member and a coupler is provided therebetween.

11. The shade of claim 7 wherein the cross section of the shaft is not circular.

12. A method for providing a variable load brake capability for a roller shade of the type which includes a tube for supporting a shade material bundle and wherein a torque of increasing strength is developed toward a free-falling state as shade material is unwound from the tube, the method comprising the steps of:

placing a threaded member in the tube and fixing the member against rotation relating to tube rotation, threading a traveling member onto the threaded member, and placing a spring in the tube and exerting an increasing spring force against the traveling member while unwinding shade material from the tube and a decreasing spring force against the traveling member as material is wound onto the shade.

13. The method of claim 12, further comprising the step of selecting the spring stiffness for a particular shade material and shade length and width.

14. The method of claim 12, comprising the further step of preadjusting the position of the traveling member on the threaded rod to establish a desirable spring force for a shade of a particular shade material and shade length.

15. The method of claim 12, comprising coupling the shade tube and the traveling member to cause rotation of the traveling member as the shade tube rotates.

16. The method of claim 12, comprising the additional step of providing a lift assist for the shade by winding a torsion spring to increase its spring force when shade material is unrolled from the tube and for unwinding the torsion spring to decrease its spring force when shade material is rolled onto the tube.

17. The method of claim 16, comprising fixing a first spring retaining component within the tube, placing at least one other spring retaining component within the tube, coupling it to the tube for rotation therewith, and coupling a torsion spring between the two spring retaining components.

18. The method of claim 17, comprising providing a shaft within the tube and fixed with respect to tube rotation and joining the first spring retaining component to the shaft and placing the second spring retaining component about the shaft so that it is free to rotate therearound.

19. A lift assist for a roller shade of the type which includes a generally cylindrical tube around which a shade material bundle is wound, the improvement comprising:

placing within the tube a keyed shaft fixed against rotation with respect to the tube;

securing to the keyed shaft a nipple having a keyed bore and a first spring coupling portion; placing about the shaft a flange having a bore exceeding the diameter of the keyed shaft so it may rotate freely about the shaft, the flange further having a first section coupled to the tube to rotate therewith, and a second section integrally formed and extending axially along the shaft, the second section including a second spring coupling portion; and coupling the flange and the nipple with a torsion spring assembly.

20. The lift assist of claim 19, wherein the nipple and flange are coupled by a single torsion spring.

21. A lift assist for a roller shade of the type which includes a generally cylindrical tube around which a shade material bundle is wound, the improvement comprising:

placing within the tube a shaft fixed against rotation with respect to the tube;

securing to the shaft a nipple having a first spring coupling portion; placing about the shaft a flange having a bore exceeding the diameter of the shaft so it may rotate freely about the shaft, the flange being coupled to the tube to rotate therewith and including a second spring coupling portion; and coupling the flange and the nipple with a torsion spring assembly; and placing a spring connector about said shaft and including third and fourth spring coupling portions, the connector having a bore with a diameter exceeding the diameter of the shaft to allow it to rotate therearound and the lift assist including a pair of torsion springs, one coupling the first and third coupling portions, and the other coupling the second and fourth coupling portions.

22. The lift assist of claim 21, wherein the spring coupling portions are all annular and wherein the diameter of the first and third coupling portions are the same and smaller than the diameter of the second and fourth coupling portion.

23. The lift assist of claim 21, wherein the flange is located intermediate the nipple and the connector.

* * * * *